US007891121B2

(12) United States Patent
Smoljo

(10) Patent No.: US 7,891,121 B2
(45) Date of Patent: Feb. 22, 2011

(54) EARTHWORKING IMPLEMENT

(76) Inventor: Doug Smoljo, 1199 Milford Bay Road, Milford Bay, Ontario (CA) P0B 1E0

( * ) Notice: Subject to any disclaimer, the term of this patent is extended or adjusted under 35 U.S.C. 154(b) by 0 days.

(21) Appl. No.: 12/142,585

(22) Filed: Jun. 19, 2008

(65) Prior Publication Data

US 2008/0313934 A1 Dec. 25, 2008

Related U.S. Application Data

(60) Provisional application No. 60/944,892, filed on Jun. 19, 2007.

(51) Int. Cl.
*E02F 3/36* (2006.01)

(52) U.S. Cl. ..... 37/447; 37/403; 37/232; 37/903; 299/69

(58) Field of Classification Search ..... 37/403, 37/404, 452, 232, 903; 299/69
See application file for complete search history.

(56) References Cited

U.S. PATENT DOCUMENTS

| | | | | | |
|---|---|---|---|---|---|
| 1,067,375 | A * | 7/1913 | Proctor | 299/67 |
| 2,228,445 | A * | 1/1941 | De Velbiss | 299/67 |
| 2,694,354 | A * | 11/1954 | Roberg | 172/423 |
| 2,770,056 | A * | 11/1956 | Hawkins | 37/301 |
| 3,065,557 | A * | 11/1962 | Pewthers | 299/67 |
| 3,269,039 | A * | 8/1966 | Bodiue | 37/411 |
| 3,293,778 | A * | 12/1966 | Mcauliff | 37/447 |
| 3,305,953 | A * | 2/1967 | Von Mehren et al. | 37/414 |
| 3,478,450 | A * | 11/1969 | Cunningham | 37/447 |
| 3,550,960 | A * | 12/1970 | Holder | 299/67 |
| 3,645,021 | A * | 2/1972 | Sonerud | 37/447 |
| 3,677,604 | A * | 7/1972 | Leyrat | 299/67 |
| 3,828,951 | A * | 8/1974 | Fleming | 414/694 |
| 3,864,852 | A * | 2/1975 | Lochrie | 37/414 |
| 4,364,191 | A * | 12/1982 | Cazes | 37/301 |
| 4,625,438 | A * | 12/1986 | Mozer | 37/447 |
| 4,959,915 | A * | 10/1990 | Roussin et al. | 37/447 |
| 5,123,710 | A * | 6/1992 | Morrell et al. | 299/69 |
| 6,209,236 | B1 * | 4/2001 | Omann | 37/405 |
| 6,301,809 | B1 * | 10/2001 | Staggs, Jr. | 37/444 |
| 6,572,324 | B2 * | 6/2003 | Ihm | 414/723 |
| 6,574,891 | B1 * | 6/2003 | Ireland et al. | 37/447 |
| 2006/0017313 | A1 * | 1/2006 | Gagnon et al. | 299/37.1 |

* cited by examiner

*Primary Examiner*—Thomas A Beach
(74) *Attorney, Agent, or Firm*—John Orange; Santosh Chari; Sean Zhang

(57) ABSTRACT

A blade assembly for an earthworking implement has a set of teeth that are independently slideable within guides. The teeth slide to conform to an undulating surface and permit scraping of the surface.

14 Claims, 11 Drawing Sheets

EARTHWORKING IMPLEMENT

CROSS-REFERENCE TO RELATED APPLICATIONS

This application claims priority from U.S. Provisional Patent Application No. 60/944,892 filed on Jun. 19, 2007 and is hereby incorporated by reference.

FIELD OF THE INVENTION

The present invention relates to a blade assembly for an earthworking implement for use in excavating.

SUMMARY OF THE INVENTION

The majority of excavation is performed by a vehicle equipped with a bucket, blade or the like, collectively referred to as an earthworking implement, that engages the soil and removes it to either a truck or to a storage area. Typically, such implements have a blade assembly with a leading edge for engagement with the soil. The leading edge may be either a single smooth edge or a toothed edge depending on the ground conditions.

The operators of the earth moving machines exhibit great dexterity in manipulating the implements so that the removal of the soil is accomplished with a minimal disturbance. However, in some operations the configuration of the leading edge prevents the efficient removal of the soil and turns the task into a relatively time consuming operation.

One such operation is removal of soil from an irregular surface such as a rock. The rock invariably has a contoured outer surface and the fixed linear leading edge found on the implement essentially establishes a single point contact. Even where a toothed edge is provided, multiple point contact is difficult to achieve and the net result is that the surface of the rock cannot be easily cleared of the soil. This hampers removal of the soil overburden, makes it difficult to ascertain the physical limits of the rock and leads to extraneous material being removed with the rock.

It is therefore an object of the present invention to provide a blade assembly for an earthworking implement in which the above disadvantages are obviated or mitigated.

In general terms the present invention provides a blade assembly for earthworking implement in which a soil engaging leading edge is segmented into a plurality of individual segments. Each segment can slide relative to the adjacent segment. The individual segments may then adopt a relative configuration that conforms to the contours of the surface over which the bucket is traversed.

Preferably, a biasing element such as a spring is used to bias the segments beyond the leading edge of the bucket.

In a further embodiment, the segments are hydraulically connected to link relative movements of the segments and accommodate the contours of the surface over which the edge is moved.

BRIEF DESCRIPTION OF THE DRAWINGS

Embodiments of the invention will now be described by way of example only with reference to the accompanying drawings in which.

DETAILED DESCRIPTION OF THE INVENTION

Figure 1:
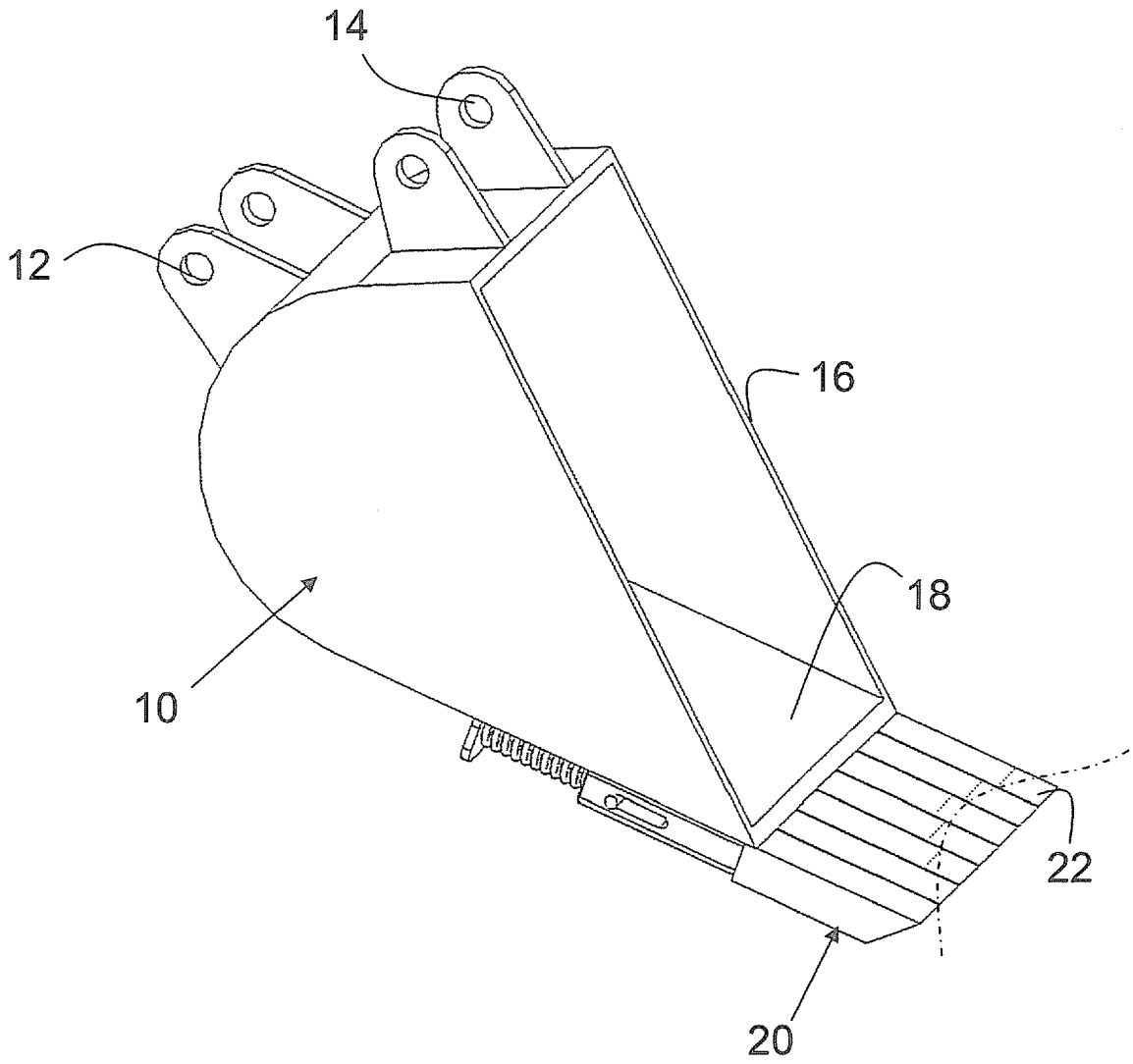
FIG. 1 is a side perspective view of a first embodiment of a blade assembly used with a bucket.
Figure 2:
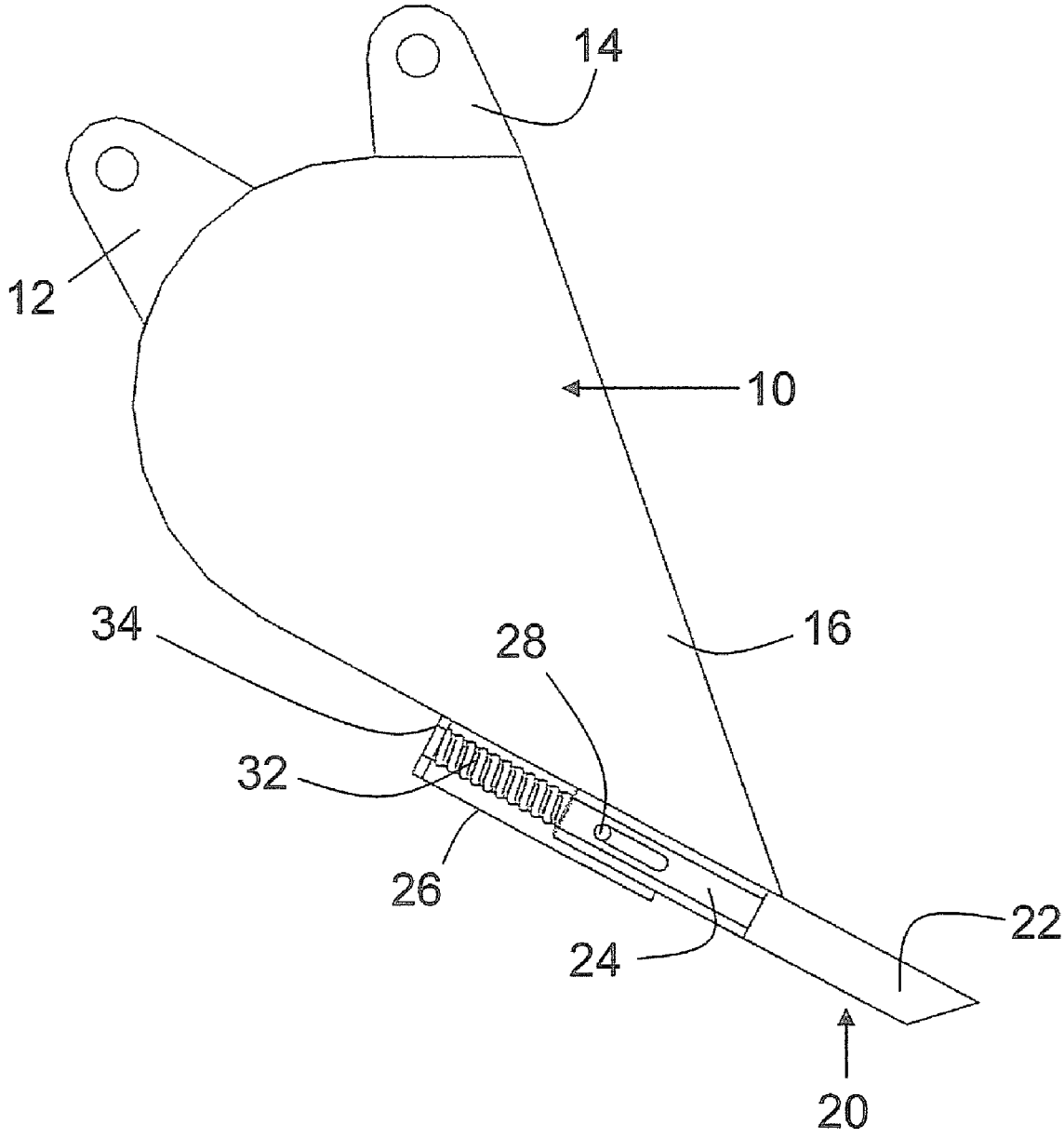
FIG. 2 is a side view of the assembly shown in FIG. 1.
Figure 3:
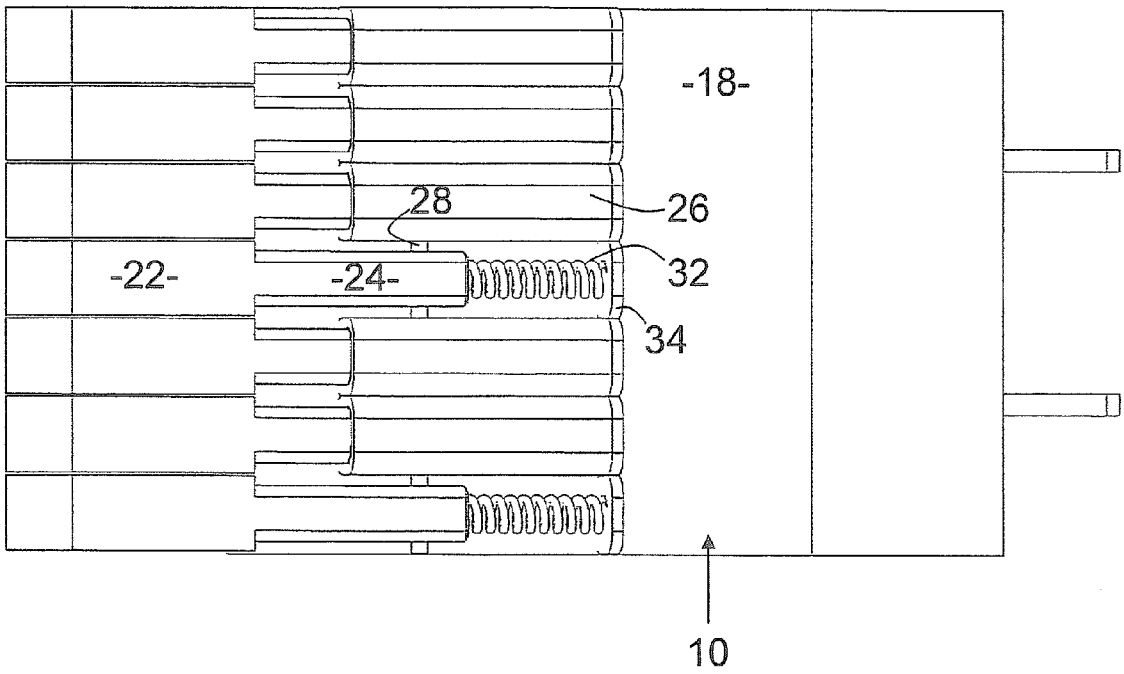
FIG. 3 is an under view with portions of the bucket shown in FIGS. 1 and 2 removed.

Referring therefore to FIG. 1, an earthworking implement shown as an excavator bucket and generally indicated at 10 is arranged to be attached through lugs 12, 14 to a boom of an earth moving machine (not shown) in a conventional manner. It will be appreciated that the exact form of the implement may vary according to the earth moving machine and maybe configured as a bucket to fit on the end of a 360° excavator boom, as a bucket for a front end loader or other commonly used configurations of bucket or as a blade of a dozer.

The bucket 10 has sidewalls 16 and a bottom wall 18. Mounted to the underside of the bottom wall 18 is an attachment in the form of a blade assembly generally indicated at 20 that provides individual segments in advance of the leading edge of the bucket 10.

The blade assembly 20 includes a plurality of teeth 22, each of which has a shank 24 extending rearwardly from the tooth 22. Each off the shanks 24 is slidably received within a respective tube 26 conveniently formed from a square section tubing welded to the underside of the base 18. The shank 24 has a slot 26 that receives a pin 28 extending laterally through the tube 26 to limit movement. The pin 28 retains the shank 24 within the tube 26 and the square section inhibits rotation of the shank 24 relative to the tube 26.

A spring 32 acts between an end wall 34 of the tube 26 and the shank 24 to bias the tooth 22 forwardly in advance of the base 18.

It will be appreciated that each of the teeth 22 is independently movable against the force of the respective spring 32. The tubes 26 act as guides for the shanks to constrain the teeth for sliding movement. The tubes 26 maintain the teeth 24 in generally planar alignment with the edges of the teeth defining a linear edge. The independent relative movement of the teeth 22 enables the teeth slide relative to one another to conform to the surface over which the teeth are moved, as indicated in chain dot lines and thereby perform a scraping action that is effective to remove the majority of the soil from the surface. Movement of the bucket is controlled by the boom operating cylinders in a normal manner and the independent movement allows a relatively smooth arc or wiping motion to be achieved with movement of the shank 24 within the tube 26 accommodating the irregularities of the surface over which the teeth 22 are moved.

Figure 4:
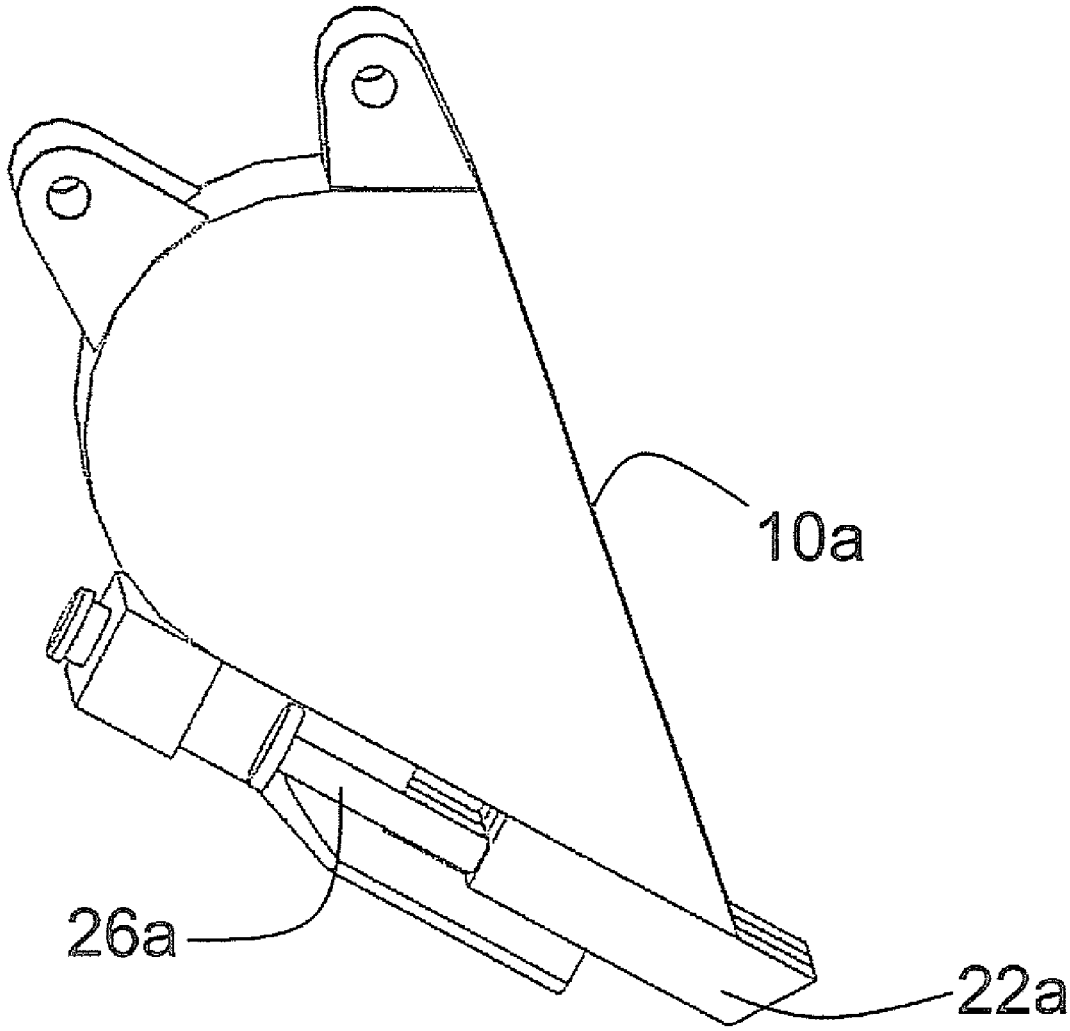
FIG. 4 is a side view of an alternative embodiment of the blade assembly.
Figure 5:
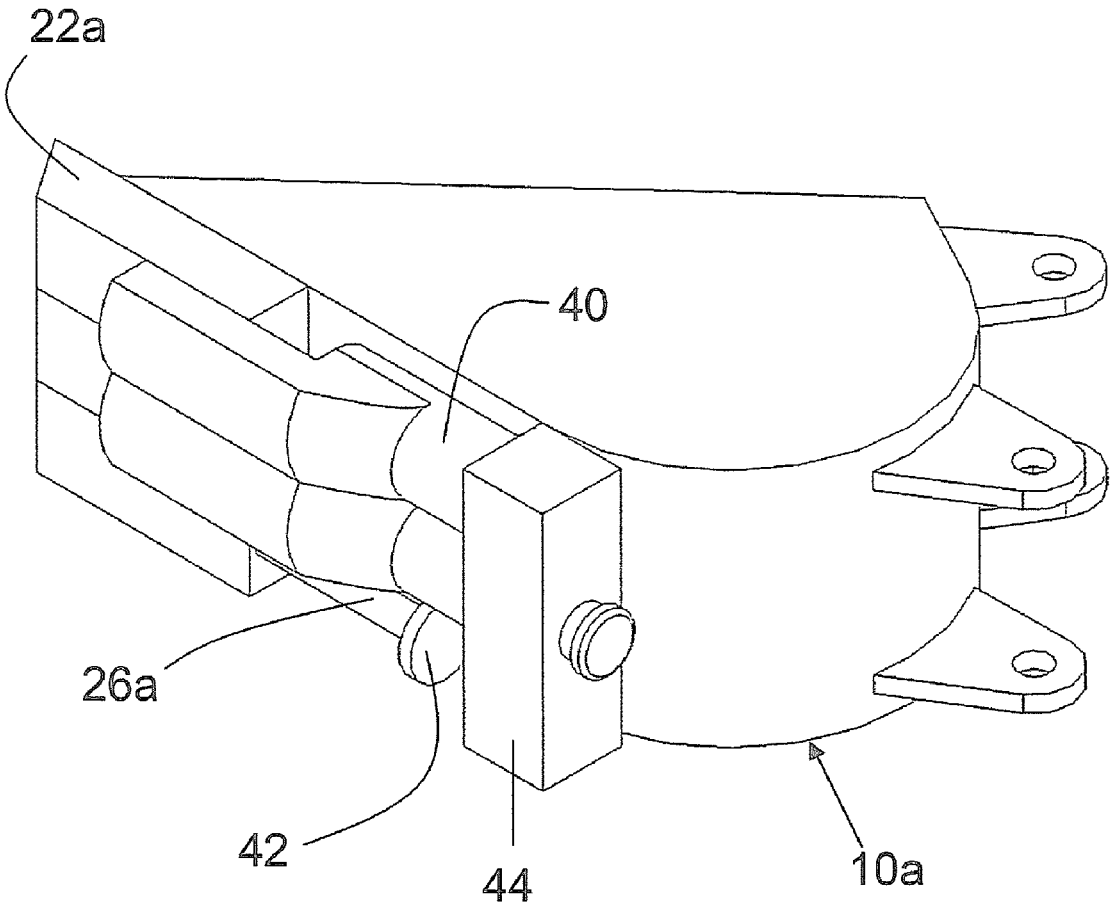
FIG. 5 is a three quarter perspective of the blade assembly shown in FIG. 4.
Figure 6:
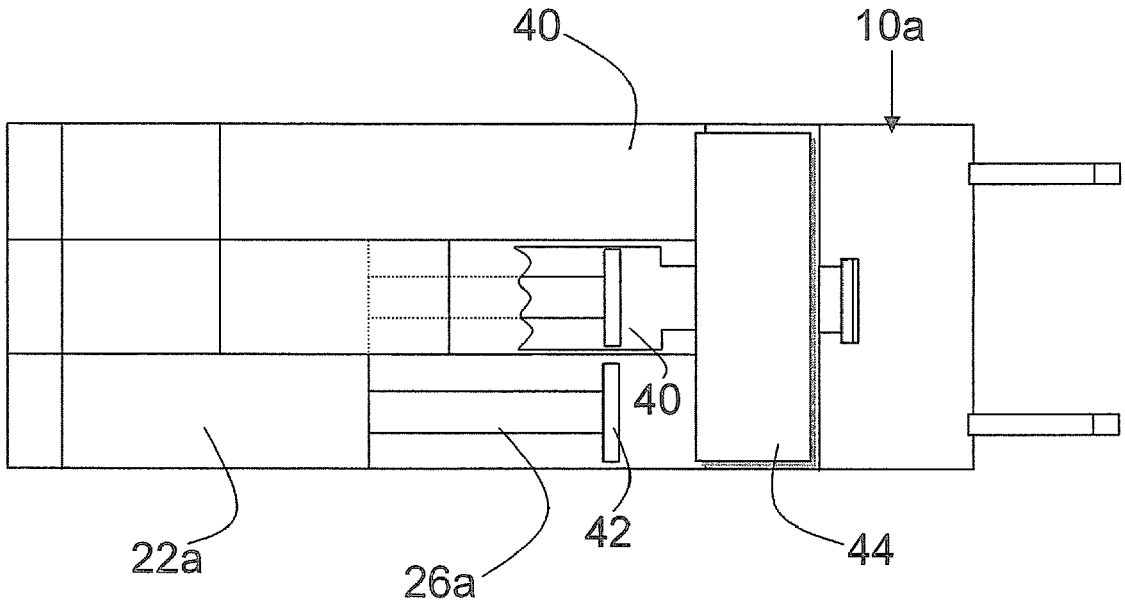
FIG. 6 is an under view of the assembly shown in FIGS. 4 and 5 with portions thereof removed for clarity.

An alternative embodiment is shown in FIGS. 4 through 6 in which like components will be identified with like reference numbers with a suffix "a" added for clarity. In the embodiments of FIGS. 4 through 6, the shanks 26*a* connected to the teeth 22*a* are formed as piston rods that slide within hydraulic cylinders 40. The shanks 26*a* are connected to pistons 42 and each of the cylinders 40 is connected to a manifold 44. The manifold 44 allows hydraulic communication between the cylinders 40 so that retraction of one of the teeth 22*a* causes a corresponding extension of one or more of the other teeth 22. Initially, the manifold 44 is filled such that each of the pistons 42 is positioned approximately half way along the cylinder 40.

In use, the normal loads placed upon the teeth 22*a* maintain the pistons 42 at a retracted position within the cylinder 40. In this condition the teeth are aligned and present a linear edge. As the teeth 22*a* traverse an irregular surface, the teeth will adjust through the hydraulic connection of the manifold to conform to the surface over which they are traversed. Thus, in the event that one of the teeth passes over a relatively shallow or concave portion, that tooth will extend and the adjacent teeth retract so that the teeth 22*a* conform to the surface.

It will be seen therefore that in both embodiments, the teeth 22*a* are allowed to conform to an irregular surface and thereby facilitate removal of soil from that surface.

A further embodiment of the blade assembly is shown in FIGS. 7 through 11 where like components will be identified with like reference numerals with the suffix b added for clarity. In the embodiments of FIGS. 1 through 6, the blade assembly 20 is mounted directly to the base 18 of the implement. In the embodiment of FIGS. 7 through 11, the blade assembly is made as a separate unit that can be mounted to the base 18 in either a permanent or dismountable manner.

Figure 7:
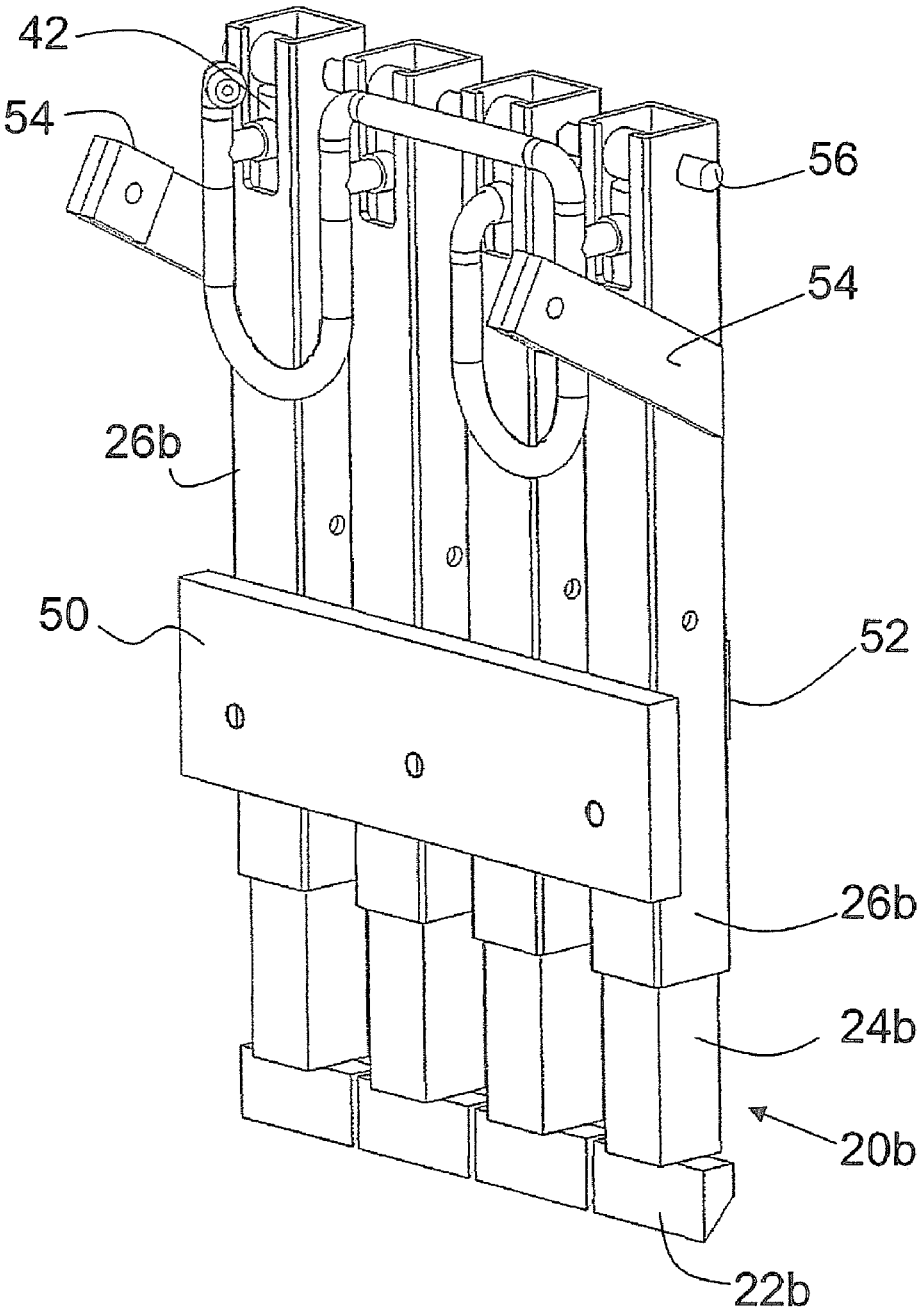
FIG. 7 is a perspective view of a further embodiment of blade assembly.
Figure 8:
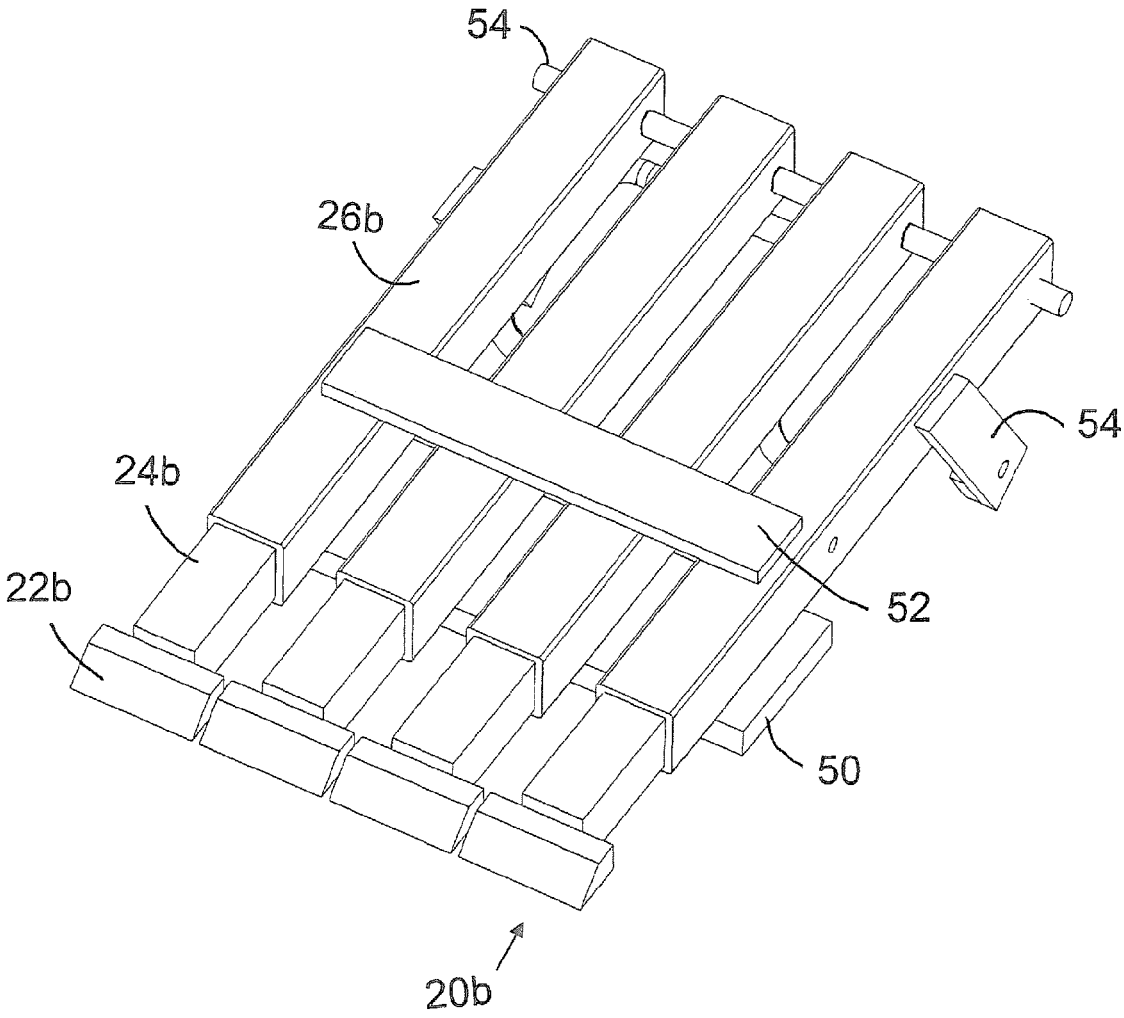
FIG. 8 is a rear perspective view of the assembly of FIG. 7.
Figure 9:
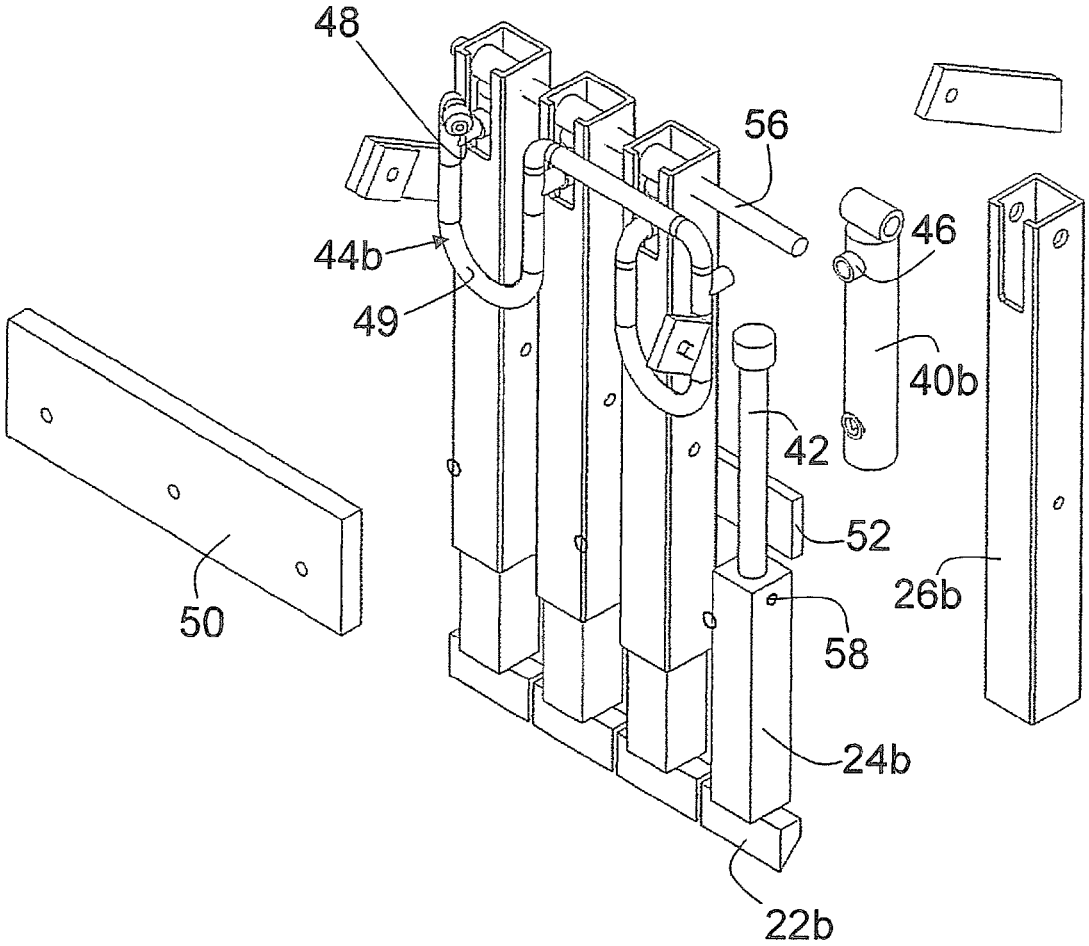
FIG. 9 is a exploded view of the assembly of FIG. 7.
Figure 10:
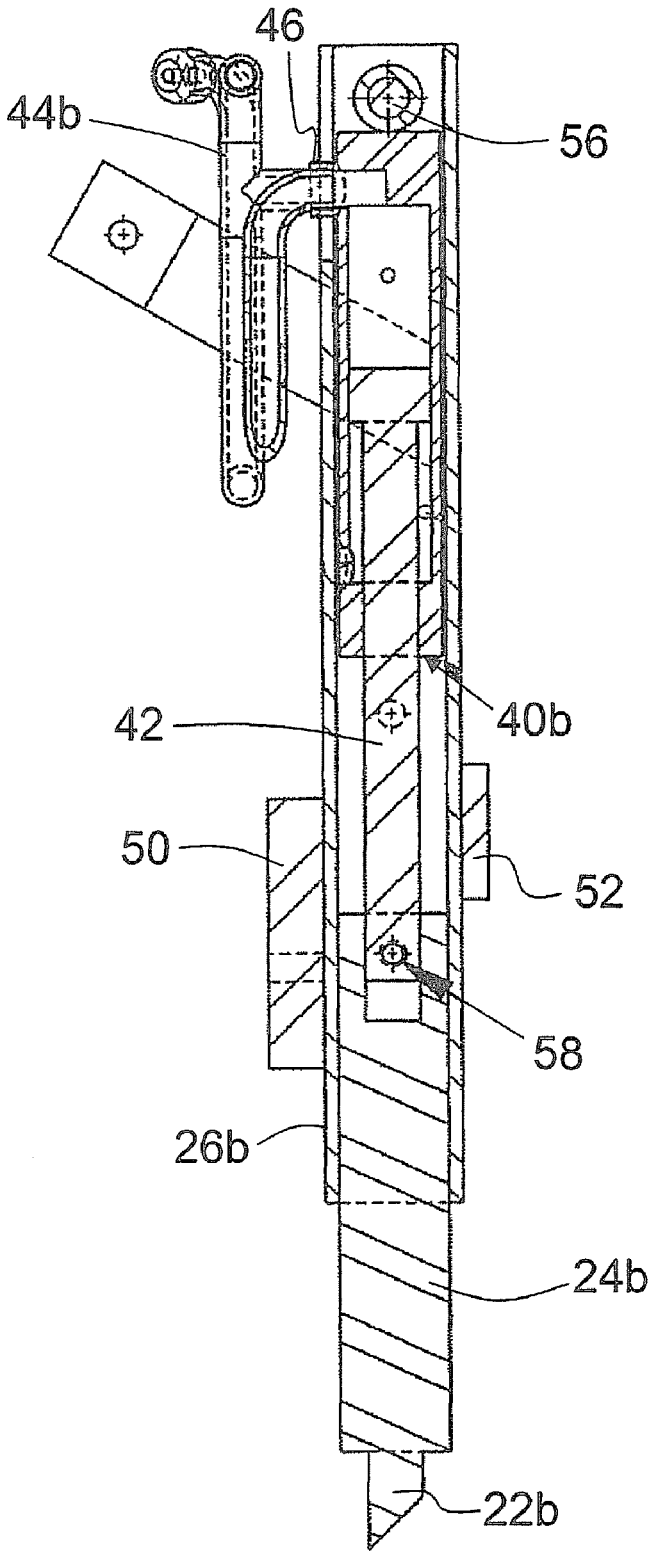
FIG. 10 is a section of the line X-X of FIG. 7.
Figure 11:
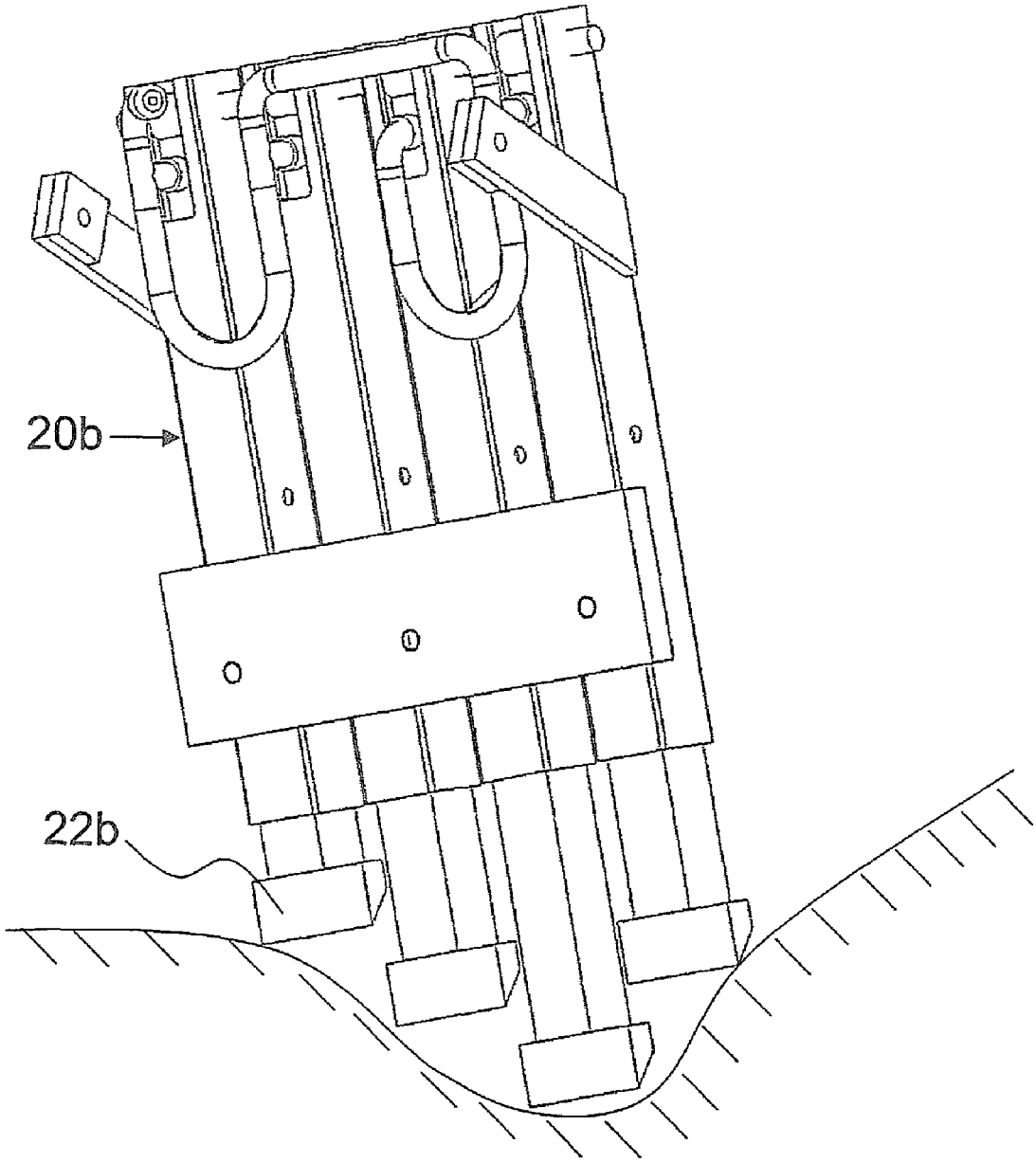
FIG. 11 is a view similar to FIG. 7 showing the blade assembly in use.

Referring therefore to FIG. 7, the blade assembly 20*b* includes a set of teeth 22*b* each of which has a square section shank 24*b*. The shank 24*b* is slidably mounted within tubes 26*b*, also of square cross section. The tubes 26*b* are mounted in parallel spaced relationship to a mounting plate 50 such that the teeth 22*b* form a substantially continuous transverse edge. As can be seen from FIG. 8, a brace 52 extends across the opposite face of the tubes 26*b* and mounting arms 54 project outwardly for connection to the bucket 10 through suitable mounting pins. Pins may also be used to connect the plate 50 to the base plate 18 or the plate 50 may be welded directly to the base plate 15 if the connection is to be permanent.

A hydraulic cylinder 40*b* is located within each of the tubes 26*b* and secured by a pin 56 that extends through each of the tubes 26*b*. A piston rod 42*b* projects from each of the cylinders 40*b* within the tubes 26*b* and is connected by way of a pin 58 to the shanks 24*b*.

The cylinder 40*b* has a head side port 46 that is connected to the manifold 44*b*. The manifold 44*b* includes T-couplings 48 and hoses 49 that form a continuous connection between each of the head side ports 46 such that cylinders 40*b* are connected in parallel. One end of the manifold includes a check valve that allows the cylinders 40*b* to be charged with hydraulic fluid.

As in the embodiment of FIGS. 4 through 6, the cylinders 40*b* are filled such that the pistons 42*b* are approximately one half of the travel along the cylinder 40*b*.

In use, the teeth 22*b* are initially aligned to present a linear cutting edge. The resistance to flow of the hydraulic fluid and the sliding connection of the shanks 24*b* within the tubes 26*b* enable the teeth 22*b* to remain aligned during normal digging operations. In the event that a surface is to be cleaned, one or more of the teeth 22*b* will extend relative to the other teeth 22*b* and allow the teeth 22*b* to conform generally to the uneven surface. Such an arrangement is indicated more clearly in FIG. 11. The teeth 22*b* may then pass across the surface and adjust continually to the undulations of the surface and thereby allow soil to be removed from the surface.

As noted above, the attachment shown in FIG. 7 through 11 may be permanently connected to the bucket 10 or may be selectively mounted on the implement when cleaning operations are to be performed.

It will be apparent that moderate biasing of the pistons to a retracted position through the use of coil springs within the rod side of the cylinder 40*b* may assist in avoiding the teeth from extending under the influence of gravity during transport or the like. Such springs would not affect the ability of the teeth to accommodate undulations in the surface.

It will also be apparent that the blade assemblies shown in FIG. 1 to 3, 4, 7 through 11 may be mounted on to the blade of a dozer allowing the lower edge of the blade to conform to the surface or an other earthworking machine to permit efficient cleaning operations.

What is claimed is:

1. A blade assembly for an earth working implement, said blade assembly comprising a plurality of teeth aligned with one another to define a ground engaging edge, each of said teeth lying in a common plane and each of them slidable in said plane relative to one another, wherein said teeth are linked to one another so that sliding movement of one of said teeth in one direction induces a complementary sliding movement of other of said teeth in an opposite direction, whereby non linearity of ground engaged by said edge is accommodated by relative displacement of said teeth.

2. A blade assembly according to claim 1 wherein said teeth are linked by a hydraulic manifold.

3. A blade assembly according to claim 2 wherein said teeth are connected to respective hydraulic actuators having a piston slidable within a cylinder and said cylinders are hydraulically connected in parallel so that displacement of one piston within its cylinder induces a transfer fluid between each of said cylinders to cause a complementary displacement of one or more of said pistons.

4. A blade assembly according to claim 3 where said teeth are connected to said piston.

5. A blade assembly according to claim 1 wherein said teeth are mounted on shanks slideable in tubes, said tubes and shanks having a complimentary cross section to inhibit rotation of said shank in said tube.

6. A blade assembly according to claim 5 wherein said shanks are connected to a hydraulic actuator having a piston and cylinder and sliding of said teeth causes displacement of said piston relative to said cylinder.

7. A blade assembly according to claim 6 wherein said actuator is located within said tube.

8. A blade assembly according to claim 7 wherein said cylinder is secured to said tube and said piston is secured to said shank.

9. An earth working implement having a plurality of guides secured in spaced parallel relationship to a base of said implement, each of said guides having a tooth mounted for sliding movement relative to said guide with said teeth aligned with one another to define a ground engaging edge, each of said teeth being interconnected to one another so that movement of one of said teeth in one direction causes a complementary movement of other of said teeth in an opposite direction, whereby non linearity of ground engaged by said edge is accommodated by relative displacement of said teeth.

10. An implement according to claim 9 wherein said guides are tubes and said teeth are connected to shanks slideable within said tubes.

11. An implement according to claim 10 wherein said shanks and tubes are of complimentary cross section to inhibit relative rotation between said tubes and said shanks.

12. An implement according to claim 11 wherein said teeth are biased to a predetermined position.

13. An implement according to claim 11 wherein said shanks are connected to said tubes through a respective hydraulic actuator and said hydraulic actuators are hydraulically connected in parallel to interconnect said teeth.

14. An implement according to claim 13 wherein said hydraulic actuators are located within said tubes.

* * * * *